US006427941B1

(12) United States Patent
Hikita

(10) Patent No.: US 6,427,941 B1
(45) Date of Patent: Aug. 6, 2002

(54) WEB TRANSPORTING METHOD AND APPARATUS

(75) Inventor: Shinji Hikita, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 44 days.

(21) Appl. No.: 09/684,835

(22) Filed: Oct. 10, 2000

(30) Foreign Application Priority Data

Oct. 8, 1999 (JP) ..... 11-288551

(51) Int. Cl.[7] ..... B65H 23/32; B65H 23/04; F26B 11/02

(52) U.S. Cl. ..... 242/615.12; 34/130; 34/362; 226/185; 242/615.2

(58) Field of Search ..... 242/615.2, 615.12; 226/97.3, 185; 34/130, 362

(56) References Cited

U.S. PATENT DOCUMENTS 2,736,106 A * 2/1956 Offen ..... 242/615.12
2,989,265 A * 6/1961 Selsted ..... 242/615.12
3,125,265 A * 3/1964 Warren et al. ..... 242/615.12
4,062,321 A * 12/1977 Greenig ..... 242/615.12
4,474,320 A * 10/1984 Rueger ..... 242/615.12
5,915,648 A * 6/1999 Madrzak et al. ..... 242/615.2
6,108,936 A * 8/2000 Vuorinen ..... 34/425

FOREIGN PATENT DOCUMENTS

| | | |
|---|---|---|
| JP | 60-93056 | 5/1985 |
| JP | 61-203055 | 9/1986 |
| JP | 62-167162 | 7/1987 |
| JP | 63-225058 | 9/1988 |
| JP | 2-163252 | 6/1990 |
| JP | 8-245028 | 9/1996 |

* cited by examiner

*Primary Examiner*—Michael R. Mansen
(74) *Attorney, Agent, or Firm*—Sughrue Mion, PLLC

(57) ABSTRACT

In a web transporting apparatus that transports a web while floating the web by jetting air from jetting holes formed in a transporting surface to the web, edge rollers that is rotatable and supports edges of the web are provided at both ends of the transporting surface. The web is transported while the edges of the web are supported by the edge rollers, and thus a floating amount of the web can be kept. Also, the supplied air can be prevented from escaping from a space between the transporting surface and the web through the edges of the web, and the web can be stably floated and transported with little air.

5 Claims, 7 Drawing Sheets

WEB TRANSPORTING METHOD AND APPARATUS

BACKGROUND OF THE INVENTION

1. Field of the Invention

The present invention relates generally to a web transporting method and apparatus, and more particularly to a web transporting method and apparatus that transports a web while floating the web by jetting air to the web.

2. Description of Related Art

Various types of apparatuses that transport webs while floating the webs by jetting air to the webs are disclosed in Japanese Patent Provisional Publication Nos. 60-93056, 61-203055, 62-167162, 63-225058, 2-163252 and 8-245028.

These apparatuses transport the webs without coming into contact with the webs. For example, in the apparatus disclosed in Japanese Patent Provisional Publication No. 60-93056, a number of air jets are formed in an arc-shaped transporting surface changing a running direction of a web, and the web is transported while compressed air is jetted from the air jets to float the web. The apparatus has guide plates, which are continuous to the transporting surface at an entrance and an exit of the transporting surface, to unify the pressure of the air jetted from the air jets. The apparatus disclosed in Japanese Patent Provisional Publication No. 61-203055 has blocks that block air jetted from air jets at an entrance and an exit of a transporting surface. The apparatus disclosed in Japanese Patent Provisional Publication No. 62-167162 has straightening vanes that straightens air jetted from air jets at an entrance and an exit of a transporting surface. The apparatus disclosed in Japanese Patent Provisional Publication No. 63-225058 has transporting plates at both ends of a transporting surface. In the apparatus disclosed in Japanese Patent Provisional Publication No. 2-163252, a number of slits are formed widthwise in a transporting surface to unify the pressure of air jetted from air jets. The apparatus disclosed in Japanese Patent Provisional Publication No. 8-245028 supports a web while bending the web.

However, in these apparatuses transporting the webs without coming into contact with the webs, the air pressures and the transporting tensions of the webs easily change, and the floating amounts of the webs easily change. As a result, the webs have twistings, biases and speed unevenness, and the webs come in contact with the transporting surfaces, which causes them to be damaged. Also, these apparatuses can not be used before or after precise coating process.

SUMMARY OF THE INVENTION

In view of the foregoing, it is an object of the present invention to provide a web transporting method and apparatus which reduces a twisting and a bias of a web to stably transport the web.

To achieve the above-mentioned object, the present invention is directed to a web transporting method, wherein: a web is transported while being floated by air jetted from at least one of a jetting hole and a jetting slit, the at least one of the jetting hole and the jetting slit being formed in a transporting surface; and edges of the web are supported by edge rollers.

According to the present invention, the web is transported while the edges of the web are supported by the edge rollers. Thus, the floating amount of the web can be kept, and the supplied air can be prevented from escaping from the space between the transporting surface and the web through the edges of the web. Therefore, the web can be stably floated and transported with little air.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

This invention will be described in further detail by way of example with reference to the accompanying drawings.

Figure 1:
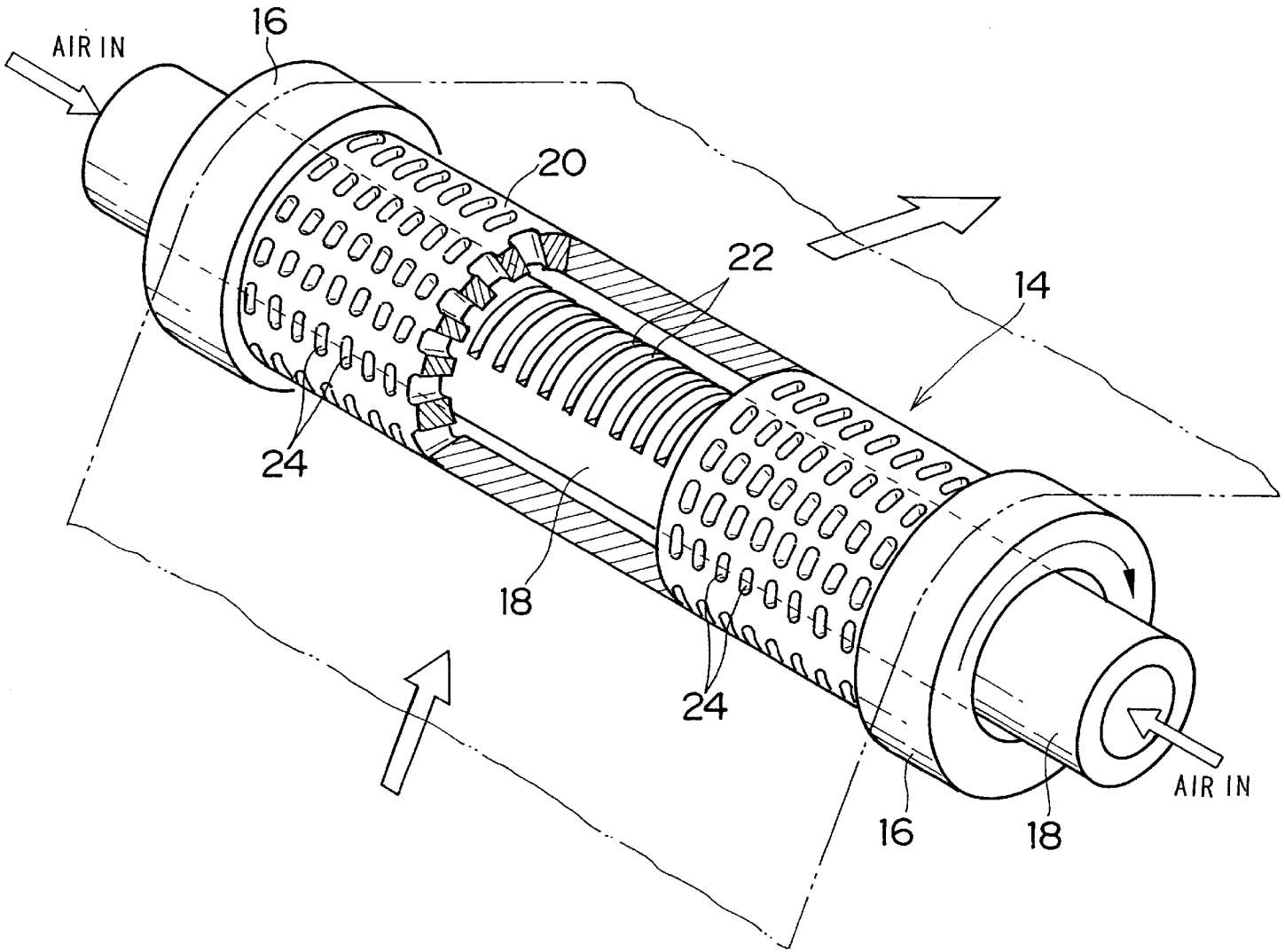
FIG. 1 is a perspective view showing the structure of a web transporting apparatus according to a first embodiment.
Figure 2:
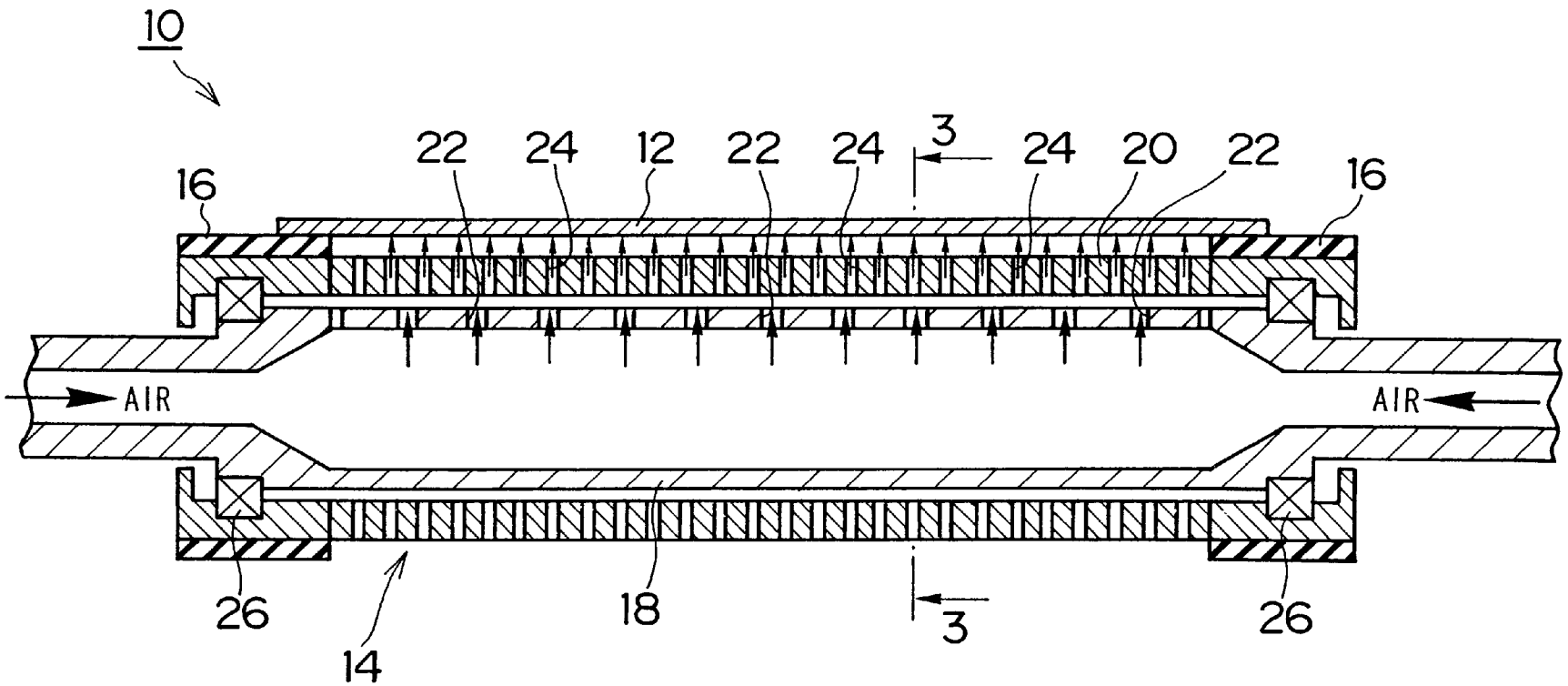
FIG. 2 is a front sectional view of the web transporting apparatus according to a first embodiment.
Figure 3:
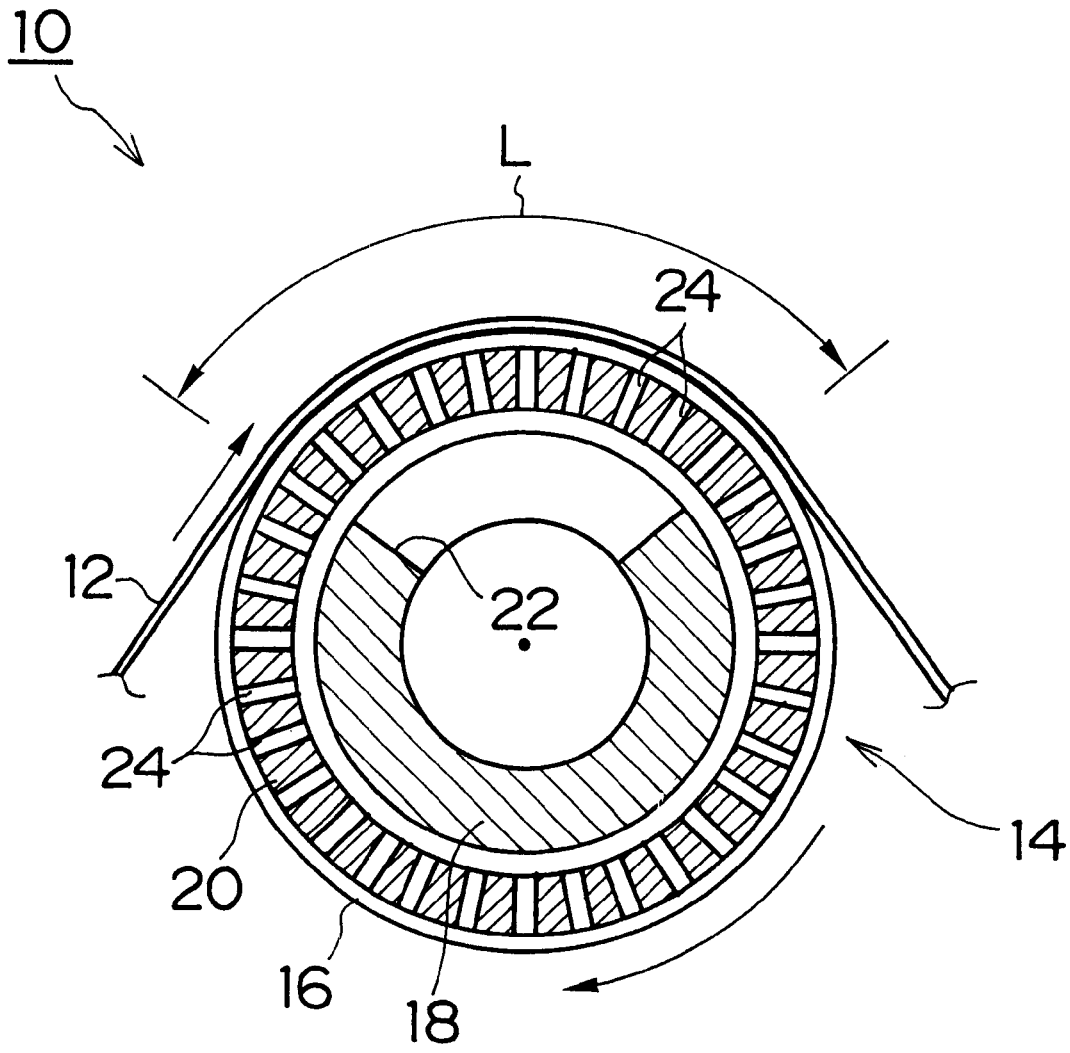
FIG. 3 is a sectional view of the web transporting apparatus along a line 3—3 in FIG. 2.

FIG. 1 is a perspective view showing the structure of a web transporting apparatus 10 according to a first embodiment, and FIG. 2 is a front sectional view of the web transporting apparatus 10. FIG. 3 is a sectional view of the web transporting apparatus 10 along a line 3—3 in FIG. 2.

As shown in FIGS. 1, 2 and 3, the web transporting apparatus 10 according to the embodiment comprises an air floating roller 14 that transports a web 12 without coming into contact with the web 12 by jetting air from its outer periphery and a pair of edge rollers 16 that supports both edges of the web 12.

The air floating roller 14 is composed of an inner cylinder 18 and an outer cylinder 20.

A number of slits (air jets) 22 are formed in the periphery of the inner cylinder 18 at fixed intervals. Each slit 22 is shaped like an arc along the periphery of the inner cylinder 18, and it has a length of L that is the same as the length of a transporting surface of the outer cylinder 20 (a surface covered with the web 12 during the transportation of the web 12). Each end of the inner cylinder 18 is supported by a supporting member (not shown), and is connected to an air supply pipe (not shown), so that compressed air is supplied to the inner cylinder 18 through both its ends.

A number of jetting holes 24 are formed in the whole periphery of the outer cylinder 20. The inner cylinder 18 is arranged inside the outer cylinder 20.

The edge rollers 16 are rotatably supported by the inner cylinder 18 of the air floating roller 14 through sealed bearings 26. The edge rollers 16 are connected to the outer cylinder 20 of the air floating roller 14, so that rotation of the edge rollers 16 rotates the outer cylinder 20. The outer diameter of the edge rollers 16 is larger than that of the outer cylinder 20. Both edges of the web 12 are supported by the edge rollers 16 when the web 12 is transported.

The operation of the web transporting apparatus 10 will now be explained.

After the compressed air is supplied to the inner cylinder 18 of the air floating roller 14 through both its ends, the compressed air is jetted out of the inner cylinder 18 through the slit 22 formed in the inner cylinder 18. The compressed air jetted from the slits 22 is jetted out of the outer cylinder 20 through the jetting holes 24 formed in the outer cylinder 20 so that the web 12 is transported without coming into contact with the air floating roller 14.

The edge rollers 16 are connected to both ends of the outer cylinder 20 from which the air is jetted, and the outer diameter of the edge rollers 16 is larger than that of the outer cylinder 20. Both edges of the web 12 are supported by the edge rollers 16 when the web 12 is transported without coming into contact with the air floating roller 14.

The web 12 keeps a fixed floating amount while being transported since both edges of the web 12 are supported by the edge rollers 16. As a result, the web 12 can be stably transported without a twisting and a bias.

The air jetted from the jetting holes 24 is prevented from escaping from the space between the web 12 and the outer cylinder 20 through the edges of the web 12 since both edges of the web 12 are supported by the edge rollers 16. Thus, the static pressure of the air is increased to strengthen the support of the web 12, and it enables the apparatus to operate with little air to reduce the running cost of the apparatus.

Since the outer cylinder 20 freely rotates, dusting due to scratches is prevented even when the narrow web 12 is guided.

Also, the edge rollers 16 reduce the amount of the air required for the floating of the web 12 to the minimum and stabilize the floating of the web 12.

An air jetting area of the inner cylinder 18 is limited by the slits 22, and the air is jetted only from a part of the inner cylinder 18 corresponding to the transporting surface of the outer cylinder 20 (the surface covered with the web 12). Thus, the compressed air is not uselessly jetted.

Running of the web 12 rotates the edge rollers 16 in synchronization with the web 12 by their friction with the web 12 since the edge rollers 16 are rotatably supported. Thus, the web 12 does not get scratches.

Though the outer cylinder 20 rotates with the edge rollers 16 since the outer cylinder 20 is connected to the edge rollers 16, the position where the air is jetted is not changed since the slits 22 are formed in the whole periphery of the outer cylinder 20. Thus, the web 12 can be stably floated.

The edge rollers 16 are rotated by their friction with the web 12 in the embodiment, but they may be rotated by motors or the like in synchronization with the web 12. This prevents the web 12 from slipping on the edge rollers 16 and thus reduces scratches on the web 12.

The jetting holes 24 are formed in the outer cylinder 20 in the embodiment, but slits may be formed in the outer cylinder 20.

The slits 22 that have the length of L that is the same as the length of the transporting surface of the outer cylinder 20 are formed in the periphery of the inner cylinder 18 in the embodiment, but holes may be formed in the inner cylinder 18, and the part of the inner cylinder 18 corresponding to the transporting surface may be cut off.

Figure 4:
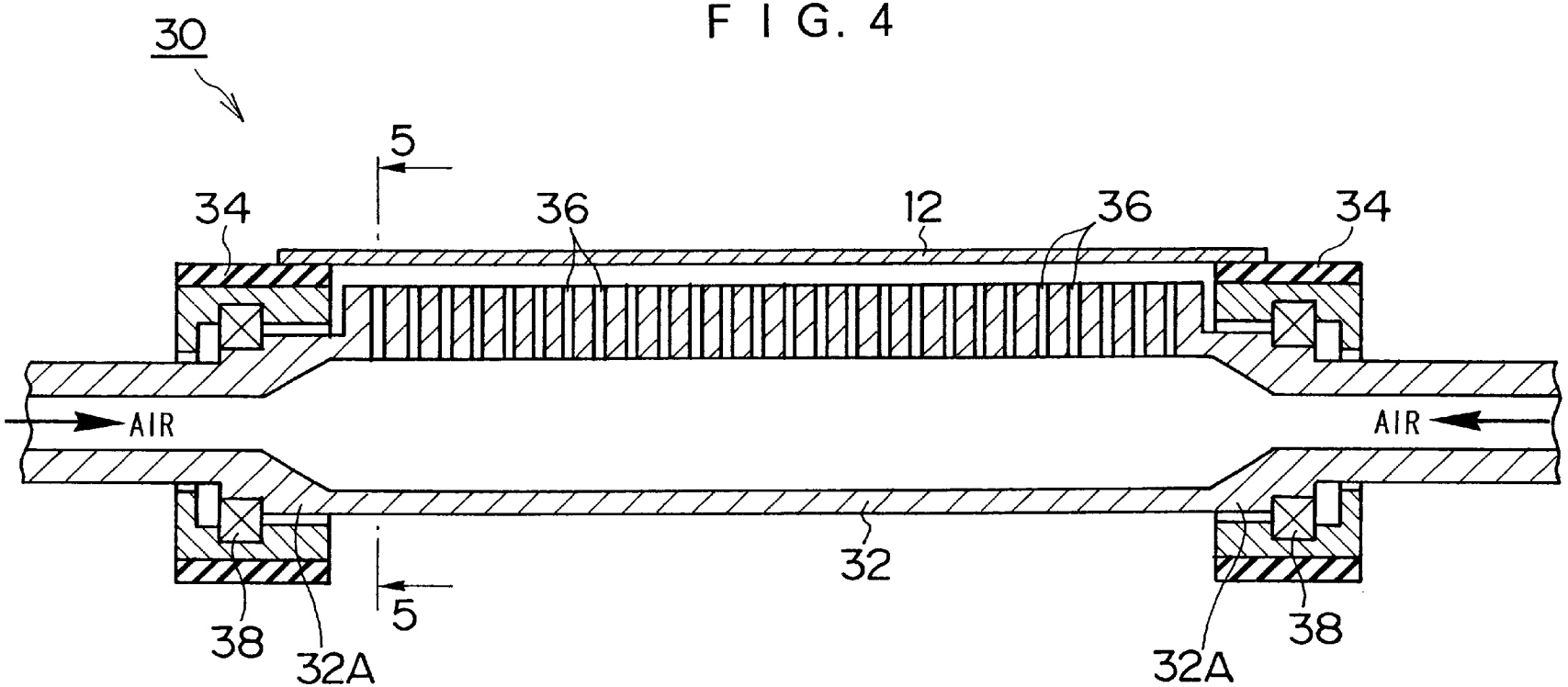
FIG. 4 is a front sectional view showing the structure of a web transporting apparatus according to a second embodiment.
Figure 5:
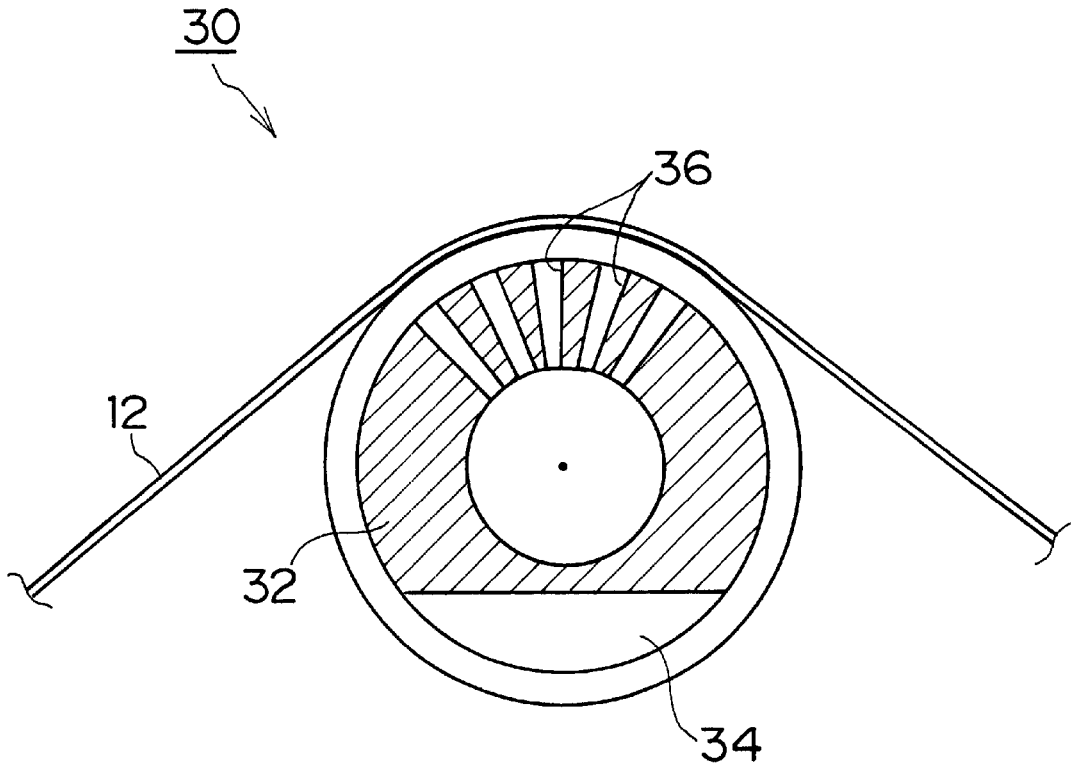
FIG. 5 is a sectional view of the web transporting apparatus according to the second embodiment along a line 5—5 in FIG. 4.

FIG. 4 is a front sectional view showing the structure of a web transporting apparatus 30 according to a second embodiment, and FIG. 5 is a sectional view of the web transporting apparatus 30 along a line 5—5 in FIG. 4.

As shown in FIGS. 4 and 5, the web transporting apparatus 30 according to the embodiment comprises an air jetting pipe 32 that is fixed at a definite position and a pair of edge rollers 34 that are rotatably arranged at both ends of the air jetting pipe 32.

The air jetting pipe 32 is shaped like a dome, and both ends of the air jetting pipe 32 are shaft parts 32A shaped like cylinders. Each shaft part 32A is supported by a supporting member (not shown), and is connected to an air supply pipe (not shown). A number of jetting holes 36 are formed in a transporting surface of the periphery of the air jetting pipe 32 (a surface covered with the web 12 during the transportation of the web 12), and compressed air is jetted from the jetting holes 36.

The edge rollers 34 are rotatably supported by the shaft parts 32A of the air jetting pipe 32 through sealed bearings 38. The outer diameters of the edge rollers 34 are larger than that of the air jetting pipe 32.

The operation of the web transporting apparatus 30 will now be explained.

After the compressed air is supplied to the air jetting pipe 32 through both its ends, the compressed air is jetted out of the air jetting pipe 32 through the jetting holes 36 so that the web 12 is transported without coming into contact with the air jetting pipe 32.

The edge rollers 34 are connected to both ends of the air jetting pipe 32 from which the air is jetted, and the outer diameter of the edge rollers 34 is larger than that of the air jetting pipe 32. Both edges of the web 12 are supported by the edge rollers 34 when the web 12 is transported without coming into contact with the air jetting pipe 32.

The web 12 keeps a fixed floating amount while being transported since both edges of the web 12 are supported by the edge rollers 34. As a result, the web 12 can be stably transported without a twisting and a bias.

The air jetted from the jetting holes 36 is prevented from escaping from the space between the web 12 and the air jetting pipe 32 through the edges of the web 12 since both edges of the web 12 are supported by the edge rollers 34. Thus, the static pressure of the air is increased to strengthen the support of the web 12, and it enables the apparatus to operate with little air to reduce the running cost of the apparatus.

Also, the edge rollers 34 reduce the amount of the air required for the floating of the web 12 to the minimum and stabilize the floating of the web 12.

The edge rollers 34 are rotated by their friction with the web 12 in the embodiment, but they may be rotated by motors or the like in synchronization with the web 12. This prevents the web 12 from slipping on the edge rollers 34 and thus reduces scratches on the web 12.

The jetting holes 36 are formed in the air jetting pipe 32 in the embodiment, but slits may be formed in the air jetting pipe 32.

Figure 6:
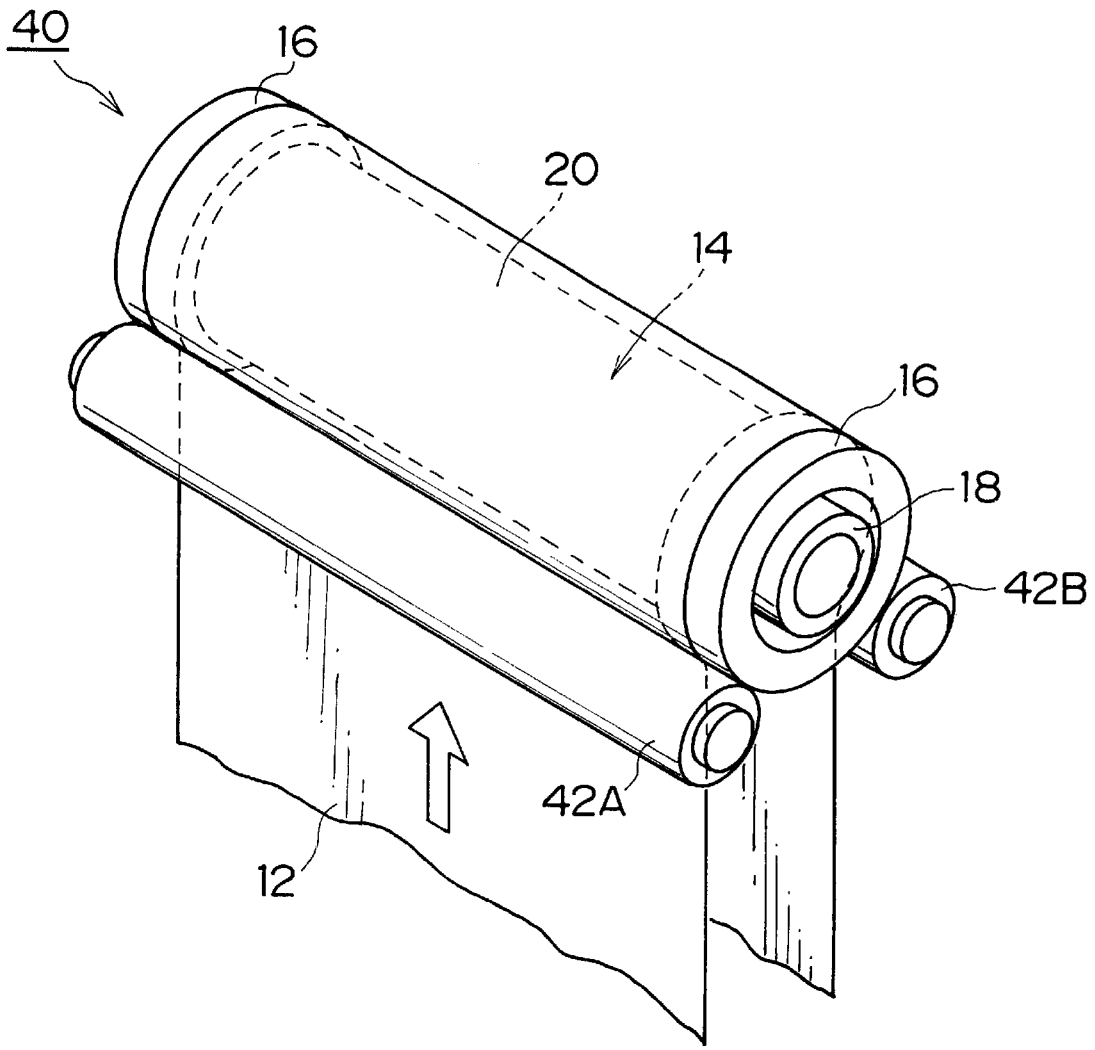
FIG. 6 is a perspective view showing the structure of a web transporting apparatus according to a third embodiment.
Figure 7:
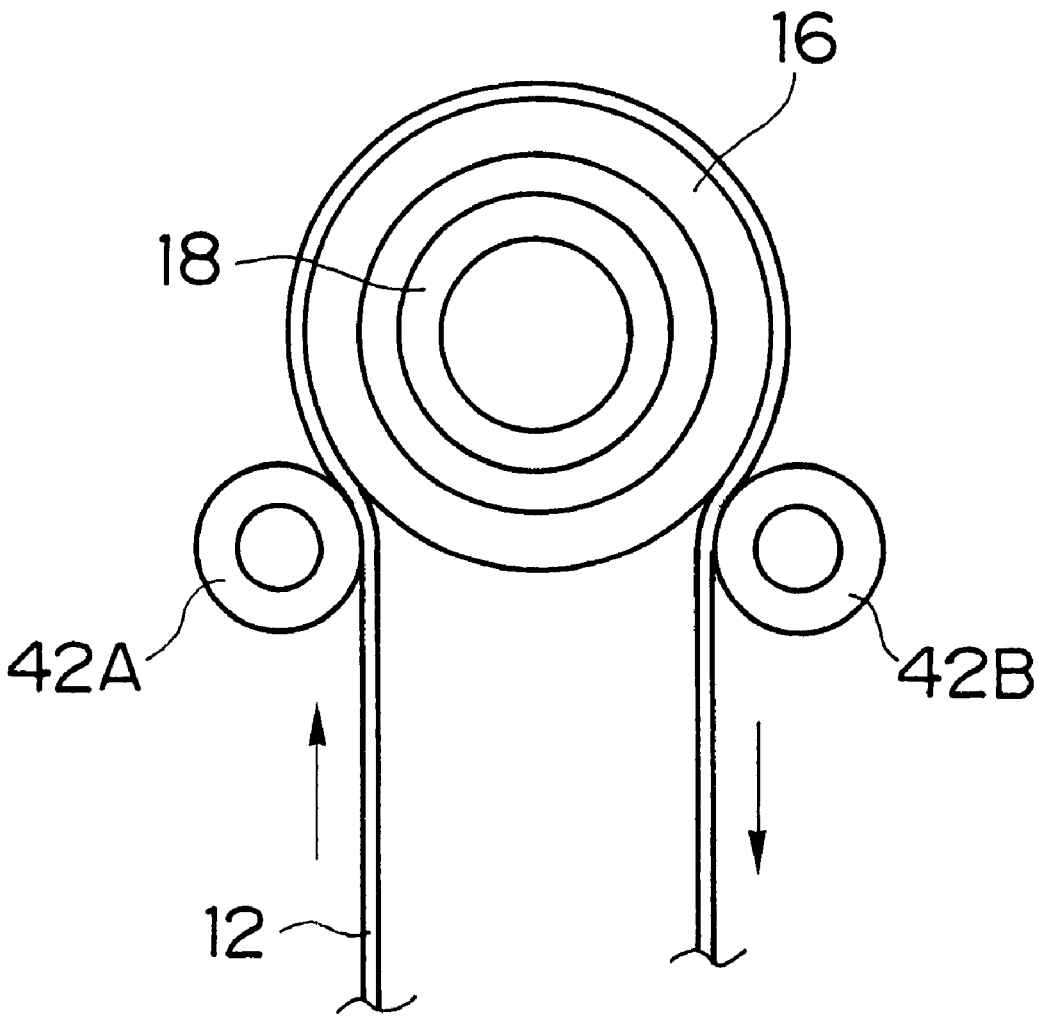
FIG. 7 is a side view of the web transporting apparatus according to the third embodiment.

FIG. 6 is a perspective view showing the structure of a web transporting apparatus 40 according to a third embodiment, and FIG. 7 is a side view of the web transporting apparatus 40. The same components as those of the web transporting apparatus 10 according to the first embodiment are denoted by the same reference numerals.

As shown in FIGS. 6 and 7, in the web transporting apparatus 40, guide rollers 42A and 42B are arranged at an entrance and an exit, respectively, of a transporting surface of the outer cylinder 20.

The guide rollers 42A and 42B are substantially as wide as the air floating roller 14, and both ends of the guide rollers 42A and 42B are rotatably supported by bearings (not shown). The guide rollers 42A and 42B are in contact with the top surface of the web 12 (the opposite surface from the bottom surface to which the air is jetted).

In the web transporting apparatus 40, the floated and transported web 12 is supported by the guide rollers 42A and 42B at the entrance and the exit, respectively, of the transporting surface of the outer cylinder 20. Thus, the web 12 is floated more stably at the entrance and the exit of the transporting surface.

The web transporting apparatuses 10, 30 and 40 in the above embodiments are preferably used under transporting conditions in the table 1.

TABLE 1

| | |
|---|---|
| Outer diameter of air floating roller | 50–300 mm |
| Difference in outer diameter between air floating roller and edge rollers | 0.1–5 mm |
| Material of edge rollers | Aluminum, aluminum with HCr plating, stainless steel or iron |
| Air supply amount | 3–30 $m^3$/min |
| Pressure of supplied air | 0.1–50 kPa |
| Width of web | 1 00–3000 mm |
| Thickness of web | 1–1000 $\mu$m |
| Transporting speed of web | 1–1000 m/min |
| Transporting tension of web | 5–2000 N per 1 m |

When the web transporting apparatuses 10, 30 and 40 were used under the transporting conditions in the table 1, the web 12 could be floated and transported without a twisting, a bias and a change of the transporting speed due to a change of the floating amount even before or after a coating processing of an optical compensation film for a liquid crystal display panel.

The web transporting apparatus according to the present invention can be used even before or after the coating processing of a printing or photographic sensitive material or the optical compensation film for the liquid crystal display panel not to come into contact with the center of the bottom surface of the web 12.

EXAMPLES

1. First Example

The web transporting apparatus 10 according to the first embodiment was used before or after the coating processing of the optical compensation film for the liquid crystal display panel under conditions in the table 2.

TABLE 2

| | |
|---|---|
| Outer diameter of air floating roller | 150 mm |
| Outer diameters of edge rollers | 152 mm |
| Air supply amount | 15 $m^3$/min |
| Pressure of supplied air | 2 kPa |
| Width of web | 1500 mm |
| Thickness of web | 100 $\mu$m |
| Transporting speed of web | 50 m/min |
| Transporting tension of web | 200 N per 1 m |

When the web transporting apparatus 10 according to the first embodiment was used under the conditions in the table 2, the web 12 could be floated and transported without a twisting, a bias and a change of the transporting speed due to a change of the floating amount even before or after the coating processing of the optical compensation film for the liquid crystal display panel.

2. Second Example

The web transporting apparatus 40 according to the third embodiment was used under conditions in the table 3.

TABLE 3

| | |
|---|---|
| Outer diameter of air floating roller | 100 mm |
| Outer diameters of edge rollers | 101 mm |
| Outer diameters of guide rollers | 80 mm |
| Air supply amount | 10 $m^3$/min |
| Pressure of supplied air | 4 kPa |
| Width of web | 1000 mm |
| Thickness of web | 50 $\mu$m |
| Transporting speed of web | 100 m/min |
| Transporting tension of web | 300 N per 1 m |

When the web transporting apparatus 40 according to the third embodiment was used under the conditions in the table 3, the web 12 was floated more stably at the entrance and the exit of the transporting surface, and the web 12 could be firmly floated even though the difference in outer diameter between the air floating roller 14 and the edge rollers 42A and 42B was small.

As set forth hereinabove, according to the present invention, the web is transported while the edges of the web are supported by the edge rollers, and thus the floating amount of the web can be kept and the web can be stably transported without a twisting and a bias. Also, the supplied air can be prevented from escaping from the space between the transporting surface and the web through the edges of the web, and the web can be floated and transported with little air.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A web transporting method, comprising the steps of:

transporting a web by floating the web radially above a transporting surface by:

jetting air from air jets of an inner cylinder, and jetting air through at least one of a jetting hole and a jetting slit formed on a periphery of an outer cylinder that is rotatable around the inner cylinder; and supporting the edges of the web by edge rollers;

wherein the transporting surface is the periphery of the outer cylinder that is radially below the web, and the web is transported radially above the transporting surface and is floated by the jetted air over the entire transporting surface.

2. A web transporting apparatus which transports a web while floating the web, comprising:

a roller including:

an inner cylinder which includes air jets formed in a part radially below an arc shaped transporting surface, and an outer cylinder which is rotatable around the inner cylinder and includes at least one of a jetting hole and a jetting slit formed in the whole periphery of the outer cylinder, wherein the at least one of the jetting hole and jetting slit jets air at the web, and the transporting surface is the periphery of the outer cylinder that is radially below the web; and rotatable edge rollers connected to both ends of the outer cylinder; wherein the rotatable edge rollers support edges of the web at both ends of the transporting surface;

wherein the web is transported radially above the transporting surface and is floated by the jetted air over the entire transporting surface.

3. The web apparatus as defined in claim 2, further comprising a guide roller arranged at one end of an entrance and an exit of the transporting surface, the guide roller supporting the web while being in contact with a surface of the web opposite from a surface to which the air is jetted.

4. The web transporting apparatus as defined in claim 2, further comprising guide rollers arranged at both of an entrance and an exit of the transporting surface, the guide rollers supporting the web while being in contact with a surface of the web opposite from a surface to which the air is jetted.

5. The web transporting apparatus as defined in claim 2, further comprising a rotating device which rotates the edge rollers in synchronization with the web.

* * * * *